United States Patent [19]

Zürner et al.

[11] 4,231,543

[45] Nov. 4, 1980

[54] CONTROLLABLE HYDRAULIC VALVE MECHANISM FOR RECIPROCATING ENGINES OR PUMPS

[75] Inventors: Hansjürgen Zürner, Ammerndorf; Wolfgang Fuhrmann, Nuremberg, both of Fed. Rep. of Germany

[73] Assignee: Maschinenfabrik Augsburg-Nürnberg Aktiengesellschaft, Nuremberg, Fed. Rep. of Germany

[21] Appl. No.: 47,322

[22] Filed: Jun. 11, 1979

[30] Foreign Application Priority Data

Jun. 9, 1978 [DE] Fed. Rep. of Germany ..... 2825316

[51] Int. Cl.[3] ..... F16K 31/122; F16L 1/34; F16L 9/02

[52] U.S. Cl. ..... 251/57; 60/560; 60/576; 60/594; 91/401; 123/90.12; 123/90.15

[58] Field of Search ..... 60/576, 586, 594, 560; 91/401, 402; 123/90.12, 90.13, 90.15, 90.16, 90.17, 90.18; 251/57

[56] References Cited

U.S. PATENT DOCUMENTS

| | | | |
|---|---|---|---|
| 1,690,032 | 10/1928 | Noble et al. | 123/90.12 |
| 2,329,662 | 9/1943 | Steiner | 123/90.12 |
| 2,443,312 | 6/1948 | Geiger et al. | 91/392 |
| 2,494,183 | 1/1950 | Lincoln | 123/90.16 |
| 2,602,434 | 7/1952 | Barnaby | 123/90.12 |
| 2,785,667 | 3/1957 | Miller | 123/90.16 |
| 3,139,077 | 6/1964 | Beucher | 123/90.12 |
| 3,369,460 | 2/1968 | Ehlke et al. | 91/402 |
| 3,872,844 | 3/1975 | Gates | 123/90.13 |

FOREIGN PATENT DOCUMENTS

| | | | |
|---|---|---|---|
| 2448311 | 4/1976 | Fed. Rep. of Germany | 123/90.12 |
| 1224168 | 3/1971 | United Kingdom | 123/90.12 |

*Primary Examiner*—Martin P. Schwadron
*Assistant Examiner*—G. L. Walton
*Attorney, Agent, or Firm*—Becker & Becker, Inc.

[57] ABSTRACT

A controllable hydraulic valve mechanism for reciprocating engines or pumps including a drive piston, operable by a cam is provided with control edges and projects into a drive cylinder; a working piston which operates the valve directly and is guided in a working cylinder. The valve mechanism provides a continuous communication between the drive cylinder interior and a second reservoir which absorbs a substantial part of the energy produced by the lift of a cam. Control sleeves surround the drive piston and are operable by actuating means operable from outside the drive cylinder. Each of the control sleeves has a control ring groove which cooperates with control edges provided in the drive piston. A further sleeve in the working cylinder surrounds the working piston, is rotatable by actuating means operable from outside the working cylinder, and is provided with a control ring groove for varying the valve lift. By means of this further sleeve, the working cylinder interior is connectable with a discharge conduit leading to the first reservoir. In this connection, the end face and the control ring groove are matched in such a way that a small amount of control fluid flows into the first reservoir during each valve lift adjustment. A cooler is provided in the refilling conduit.

10 Claims, 2 Drawing Figures

Figures 1, 2:
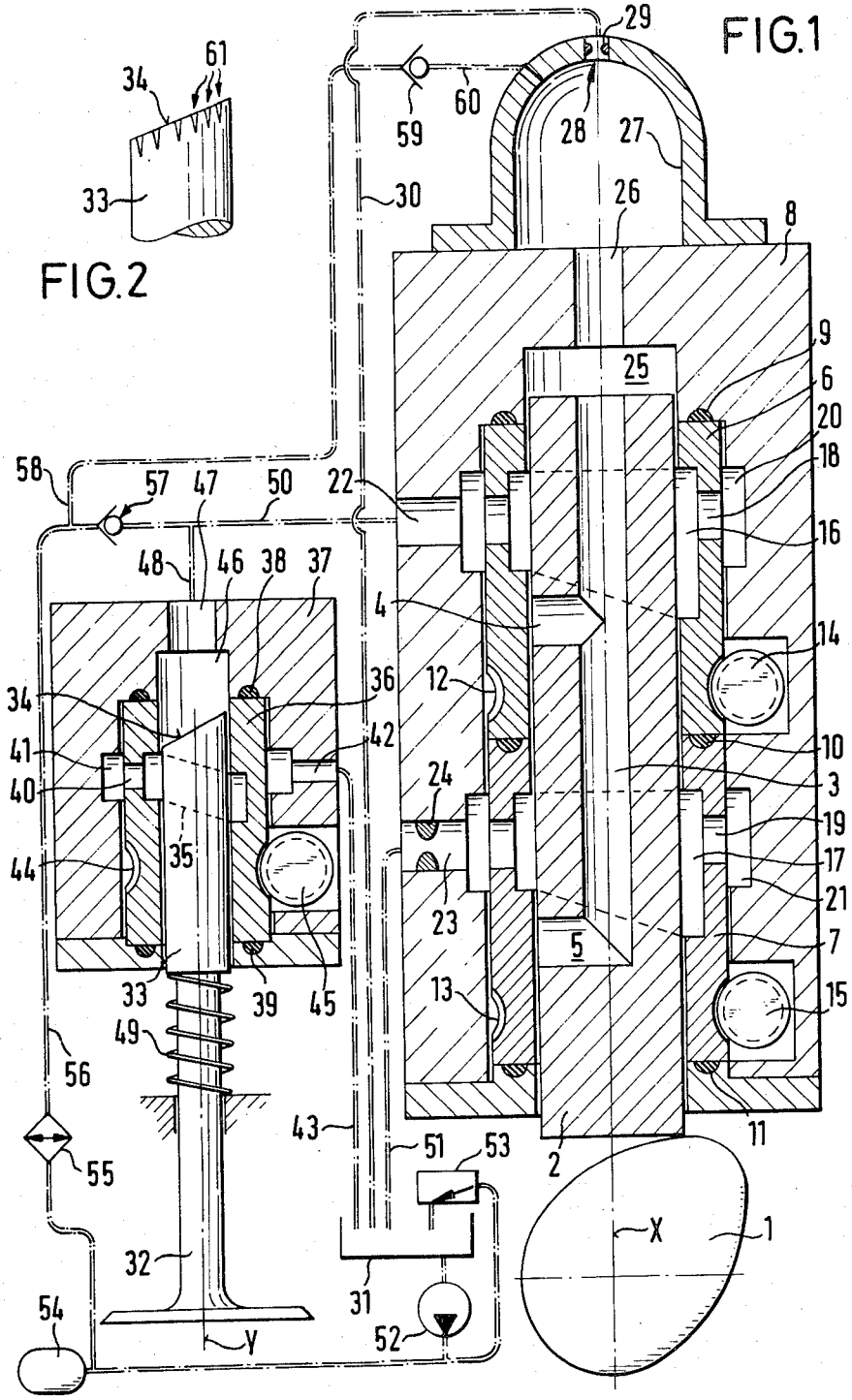

29
60
59
28
27
30
26
8
9
6
20
18
16
14
10
3
19
17
21
7
15
11
2
1
X
25
5
22
4
12
24
23
13
58
57
47
50
48
46
38
37
36
42
34
41
40
44
35
33
39
45
49
56
55
32
54
Y
43
51
53
31
52
61
34
33

CONTROLLABLE HYDRAULIC VALVE MECHANISM FOR RECIPROCATING ENGINES OR PUMPS

The present invention relates to a controllable hydraulic valve gear or mechanism for reciprocating engines or pumps, and includes a drive piston which is operable by a cam, is provided with control edges, and projects into a drive cylinder; a working piston which operates the valve directly and is guided in a working cylinder; a control conduit interconnecting the two cylinders; a reservoir for the control fluid; a refilling conduit which interconnects the reservoir and the drive cylinder and is provided with a pump; and a return conduit which is provided with a relief valve.

One such valve mechanism is known. It forms practically a closed system, and incorporates in the refilling line a pressure reservoir and a pump which generates pressures at different levels. Due to the different pressure levels that can be adjusted, it was possible to vary the valve timing within certain limits. However, it was soon found that the arrangement was unable to meet the exacting requirements in respect of constancy and reproducibility of the valve timing which have to be imposed today, especially since variations in the valve timings have considerable consequences on exhaust emissions. The operation of this heretofore known mechanism was simply too inaccurate.

The reason for this lies mainly in the fact that several parameters are varied at the same time when the elastic behavior of the oil column between the two cylinders is interfered with. For instance, the start of opening, the closing time, and the lift of the valve will be simultaneously influenced.

Furthermore, this known mechanism failed to take into account that the control fluid, generally oil, varies in its air content during operation. Variations of the air content are, however, synonymous with extremely wide variations in the elastic behavior of the oil column. If air-free oil were available, it would possibly be conceivable to find a compromise whereby the combination of the three aforementioned parameters would lead to acceptable results.

Actually, there is no air-free oil. Even oil that has been vacuum-treated to remove air will, after only short-time exposure to air, and even more so when passing through pumps, valves, return lines and reservoirs, absorb considerable amounts of air, partly in dissolved form and partly in emulsified form. Practically speaking, however, the three parameters referred to above are liable to change in a short period in a manner quite inconsistent with the intended purpose.

Moreover, it should be mentioned that, together with the air content in the control fluid, the dependence of the elastic properties on temperature increases to a marked extent and in a very unpredictable manner. This and other heretofore known valve mechanisms can therefore lead to failure during temperature changes, which in an engine are quite unavoidable.

U.S. Pat. No. 2,602,434 discloses a controllable hydraulic valve mechanism according to which the valve opening or valve closing timing is adjustable within limits by means of an oblique surface provided on the drive piston when the piston is rotated. The opening lift of the valve, too, is variable by a similar arrangement on the working piston. However, no consideration is given to removing air from or even continuously removing air from the control fluid, so that here too variations of the parameters and, consequently, undesirable conditions are liable to occur after a short period of time. Nor does this patent take into account any temperature changes.

With both aforementioned valve mechanisms, there is an added drawback in the fact that the same oil column oscillates nearly constantly in the conduit between the drive cylinder and the working cylinder. In the case of extended oscillation of oil columns, especially under conditions of continuously changing pressures, degradation of the oil is liable to result, additionally causing substantial changes in the elastic properties of the oil, unless the oil is renewed.

Finally, another pressure fluid valve mechanism for internal combustion engines is known, according to which a greater amount of control fluid is caused to move during every control cycle of the drive cylinder than is needed to open the valve. The excess fluid is withdrawn by outlet valves connected to the working piston, the object being to take along any air bubbles.

In this manner, a certain amount of air removal avoidance of excessive heating, and also renewal of the control fluid are obtained, but no provision is made for any control of valve opening, valve closing, or the lift of the valve.

It is an object of the present invention to realize control of the valve timings which remain constant over the operation of the equipment and are reproducible after shutting down and restarting the engine.

It is therefore a further object of the present invention to improve a controllable hydraulic valve mechanism of the aforementioned general type in such a way that all of the drawbacks mentioned are avoided, i.e. that the start of opening, timing of closing, and the lift of the valve can be varied independently of each other, and that adequate air removal, constant cooling, and also continuous renewal of the control fluid are automatically effected, making consistently accurate control possible.

These and other objects and advantages of the present invention will appear more clearly from the following specification in connection with the accompanying drawing, in which:

FIG. 1 schematically shows the complete valve mechanism according to the invention; and FIG. 2 is an enlarged view of the upper part of the working piston.

The valve mechanism of the present invention is characterized primarily by providing a continuous communication between the drive cylinder interior and a reservoir which absorbs a substantial part of the energy produced by the lift of the cam. At its highest point, the reservoir has a bore with a restriction, from where a discharge conduit leads to a second reservoir. The drive cylinder is provided with two independently rotatable control sleeves arranged end-to-end in the axial direction. The control sleeves surround the drive piston and are operable by actuating means outside the drive cylinder. Each of the control sleeves has a control ring groove which cooperates with control edges provided in the drive piston. The control ring groove of one of the control sleeves is connectable with the interior of the working cylinder for infinitely variable adjustment of the valve opening time of the interior of the drive cylinder. The control ring groove of the other control sleeve is connectable with the second reservoir by a restriction for infinitely variable adjustment of the valve closing time of the drive cylinder interior. A further control sleeve is provided in the working cylinder. This control sleeve surrounds the working piston (which is equipped with an oblique face), is rotatable by actuating means operable from outside the working cylinder, and is provided with a control ring groove for varying the valve lift. By means of this further sleeve, the working cylinder interior is connectable with a discharge conduit leading to the second reservoir. In this connection, the end face and the control ring groove are matched in such a way that a small amount of control fluid flows into the second reservoir during each valve lift adjustment. A cooler is provided in the refilling conduit.

In other words, there is a meaningful combination of interacting and mutually supplementing, partly known, features. The reservoir connected with the drive cylinder interior absorbs a substantial part of the energy generated by the lift of the cam. This energy can be recalled at the desired time and can be supplied to the working cylinder. A small portion of the control fluid is continuously expanded by and through the restriction and returned to the second reservoir. This causes the control fluid and the air to be effectively separated from one another. The air emerges at the end of the discharge conduit in the form of bubbles, while the control fluid flows back into the second reservoir. Thus continuous air removal is effected.

The use of the two control sleeves, which surround the drive piston and are rotatable independent of one another by means provided outside the drive cylinder, satisfies the requirement that the valve opening timing and the valve closing timing be freely adjustable within wide limits and, consequently, are capable of being coordinated. The restriction which precedes the second reservoir serves to throttle the return flow of control fluid returning from the working cylinder upon closing of the valve to such an extent that equilibrium results between the pressure drop caused by commencing discharge and the pressure increase caused by the drive piston which at this time is still moving upwardly. This equilibrium counteracts any unintentional reduction of the valve lift with this type of control of the closing timing.

The control sleeve surrounding the working piston also permits the third parameter, i.e. the valve lift, to be adjusted independently of the other parameters, with the control ring groove and the oblique end face being arranged relative to one another in such a way that, in any position of the control sleeve prior to closing of the valve, part of the control fluid flows directly into the second reservoir so that the control fluid pulsating back and forth between the drive cylinder and the working cylinder is gradually renewed again and again. This eliminates any degradation of the control fluid.

The cooler ensures that the control fluid always has nearly the same temperature before it enters the drive cylinder. Thus, all requirements are met.

In particular, it is proposed according to the present invention that the reservoir be mounted on top of the drive cylinder, be connected by a bore with the interior of the drive cylinder, and be formed as a hydraulic-pressure reservoir. However, it is alternatively also possible to use a spring-loaded piston reservoir.

With a view to facilitating manufacture, it is proposed that the control edges provided in the drive piston be formed as transverse bores and be made to communicate with the interior of the drive cylinder by means of a common longitudinal bore.

Regarding the actuating means for the control sleeves in the drive cylinder and in the working cylinder, it is proposed according to the present invention that this means respectively consists of a worm gear formed integrally with the respective control sleeve, and a worm extending through the respective cylinder.

Finally, the present invention provides that the oblique end face of the working piston be provided with small wedge-shaped notches or recesses in order to afford convenient metering of the small amounts of control fluid which are discharged for continuous renewal. Depending on the length of control conduit, it is proposed according to the present invention that between 1/5 and 1/50 of the volume of the control conduit be renewed per stroke.

Referring now to the drawing in detail, and specifically to FIG. 1, a cam 1 actuates an input or drive piston 2, which is provided with a longitudinal bore or drilled passage 3 with which two lateral transverse bores or drilled passages 4 and 5 communicate. The drive piston 2 slides and is an oiltight ground fit in two rotatable control sleeves or bushings 6 and 7, which in turn are supported in an input or drive cylinder 8 and are sealed relative to one another as well as relative to the drive cylinder 8 by the seals 9, 10, and 11. The control sleeves 6, 7 are respectively provided on their outer peripheries with an integral worm gear 12, 13 in which mesh worms 14, 15 supported in the drive cylinder 8 and adapted to be turned from the outside. The worms 14, 15 serve to rotate the control sleeves 6 and 7 to any desired angular position. The control sleeves 6 and 7 are provided with control ring grooves 16 and 17, each of which has an upper edge extending perpendicular to the longitudinal axis x. The lower edges of these control ring grooves 16, 17 extend obliquely to the axis x. If the control sleeves 16, 17 are in the position shown, the transverse bores 4 and 5 of the drive piston 2 will overlap both the control ring groove 16 and the control ring groove 17 only when they are moved relatively far towards their top position. If, however, the control sleeves 16, 17 are turned 180°, overlapping will already occur when the drive piston 2 is in a considerably lower position.

Connecting bores or passages 18, 19 lead from the control ring grooves 16, 17 to annular grooves 20, 21 in the drive cylinder 8. These grooves 20, 21 in turn communicate with drilled passages or bores 22, 23, through which the control fluid is delivered, via hydraulic circuits shown by dot-dash lines, to other components.

The bore 23 has a throttle area or restriction 24, and is connected to a discharge circuit 51 which leads into the reservoir 31. The interior 25 of the drive cylinder 8, which interior 25 is situated at the end of the drive piston 2, communicates by means of a drilled passage or bore 26 with a reservoir 27, which in this example is illustrated as a hydraulic reservoir but may alternatively also be a spring-loaded piston reservoir. From the reservoir 27, through a drilled passage or bore 28 with a restriction 29, a discharge circuit 30, which is provided at the highest point, likewise leads into the reservoir 31.

Associated with the drive cylinder 8 is an output or working cylinder 37, which actuates the valve 32. The valve 32 has a stem designed as an output or working piston 33. The working piston 33 has an end face 34 which is oblique to the longitudinal axis y and cooperates with a likewise oblique control ring groove 35 in the control sleeve or bushing 36, which is guided in the working cylinder 37 and is sealed relative to it by seals 38, 39. The control ring groove 35 communicates with an annular groove 41 in the cylinder 37 by means of a drilled passage or bore 40. By means of a drilled passage or bore 42, the annular groove 41 in turn communicates with a conduit 43 which leads into the reservoir 31.

A worm gear 44 is formed integrally on the outer periphery of the control sleeve 36, permitting the control sleeve 36 to be turned to any desired angular position by a worm 45 which is supported in the working cylinder 37 and is operable from the outside. The interior 46 of the working cylinder 37, which interior 46 is situated at the end face of the working piston 33, communicates by means of a drilled passage or bore 47 with a control conduit 48 which, by means of a control conduit 50, leads to the bore 22 of the drive cylinder 8. Resetting of the valve 32 is effected by a spring 49.

Finally, a refilling conduit 56 extends from the reservoir 31 via a pump 52, a cooler 55, and a non-return or check valve 57 into the control conduit 50, and a branch conduit 58, 60, which is likewise provided with a non-return or check valve 59, extends from a point ahead of the check valve 57 to the reservoir 27. The refilling conduit 56 furthermore communicates with a compensating reservoir 54 and a relief or overflow valve 53.

Method of Operation:

If the cam 1 pushes the drive piston 2 upwardly, there is initially no connection between the transverse bore 4 and the control ring groove 16, nor between the transverse bore 5 and the control ring groove 17. The control fluid, preferably oil, present in the drive cylinder 8 is thus conveyed to the reservoir 27, where it is compressed. A small portion of this oil is depressurized or expanded in the restriction 29 and is returned into the reservoir 31 through the discharge conduit 30. During the expansion in the restriction 29, oil and air are very effectively separated from one another. The air emerges from the discharge conduit 30 in the form of bubbles, while the low-air-content oil passes into the reservoir 31 for further use. This continuous removal of air from the oil contributes substantially towards maintaining the conditions for the elastic behavior of the oil columns.

If an earlier start of opening of valve 32 is required, the control sleeve 6 is turned approximately 180° from the position illustrated. The transverse bore 4 and the control ring groove 16 then overlap each other relatively quickly. The valve 32, with the interior 46 of the working cylinder 37 being connected by the control conduits 48, 50 with the control ring groove 16, opens and is forced open even further by the remaining lift of the drive piston 2.

If a later start of opening of valve 32 is required, the control sleeve 6 will be approximately in the position shown in the drawing. Opening of the valve 32 will be effected late, because rotation of the cam 1 will have to have advanced considerably before the transverse bore 4 and the control ring groove 16 overlap one another. However, the full energy continues to be available for opening the valve 32, since the oil displaced by the drive piston 2 has not in the meantime flowed away as in the prior art, but rather has been compressed, and consequently kept ready in the reservoir 27. At the moment when the transverse bore 4 and the control ring groove 16 overlap, the oil also flows from the reservoir 27 through the bore 26, the longitudinal bore 3, the transverse bore 4, the connecting bore 18 and the bore 22 into the control conduit 50, ensuring that the valve 32 is opened to its full lift.

In other words, shifting the opening time is no longer coupled with any variation of the valve lift; rather, the latter is kept constant in the manner desired.

If a reduction of the valve lift is desired, it is only necessary to turn the control sleeve 36. As soon as the bottommost part of the oblique end face 34 of the working piston 33 coincides with the adjustable upper edge of the control ring groove 35, oil flows through the bore 40 and the annular groove 41 into the discharge conduit 43 and, consequently, into the zero pressure reservoir 31. This prevents a further increase in the lift of the valve 32.

The system is dimensioned in such a way that in every case at the end of the valve lift a small amount of oil passes past the working piston 33 or, respectively, the oblique end face 34, through the bore 40, the annular groove 41 and the bore 42, and via the discharge conduit 43 into the reservoir 31. This arrangement prevents the same oil column from constantly oscillating in the control conduit 48, 50.

If, however, the closing time of valve 32 is to be affected, the control sleeve 7 is turned. As a result, the interior 46 of the working cylinder 37 is depressurized earlier or later, depending on the timing of the overlap of the transverse bore 5 with the control ring groove 17. In this connection, it is conceivable that if the valve 32 closes very early, its full lift will not have been attained at the time that the closing phase is already to be initiated. In this case, the restriction 24 has a compensating effect. As a result of the cooperation of the drive piston 2, which continues to displace oil from the interior 25 of the drive cylinder 8, with the discharge occurring through the restriction 24, substantially full valve lifts are attained in spite of the advanced timing of valve closing.

The measures to remove air from the oil are supplemented by the following: The pump 52 ensures that the oil pressure in the complete system is maintained at a high enough level that a negative pressure can never arise, even at those points of turbulent separation or at narrowly limited localized points. Such points of negative pressure at control edges, etc. cause air to be drawn into the system, through connecting parts which are oiltight but not vacuumtight, thereby intimately mixing with the oil. The relief valve 53 therefore serves as an important device for keeping the pressure constant.

The oil at its initial pressure then passes through the cooler 55, which effects a constant oil temperature. The reservoir 54 serves to control or reduce pump pulsations. The check valve 57 prevents return flow to the pump 52 in a known manner.

In order to safeguard against the unlikely case of a negative pressure developing in the reservoir 27 during the return stroke of the drive piston 2, with the result that air can be drawn in, the branch conduit 58 is provided, by means of which the reservoir 27, with the aid of the check-valve 59 and the branch conduit 60, is continuously kept at a minimum pressure which corresponds to the initial pressure of the pump 52.

Referring to FIG. 2, the oblique end face 34 of the working piston 33 has small wedge-shaped notches or recesses 61, permitting an improved dosing or metering of the small amounts of oil which are to be discharged during each valve lift.

Finally, it is proposed, on the strength of a typical calculation, to demonstrate that the reservoir 27 described is actually capable of being realized. Assume that the actuating force for the valve 32, which force has to overcome the force of the spring 49, the inertia force and the gas force on the valve disc, is a maximum of 3000 N. For this purpose, a pressure in the control conduit 48 of 1200 N/cm$^2$ should be sufficient. Accordingly, the drive piston 33 is formed with an area of 2.5 cm$^2$ (18 mm dia.). With a valve lift of 14 mm, pressurized oil is required at a rate of 2.52 cm$^3$/stroke. Added to this is an amount of less than 0.5 cm$^3$ per stroke to account for the unavoidable compressibility of the oil in the control conduit 50, 48, in the interior 46 of the working cylinder 37, and in the bore 47, so that by providing a total volume of 3 cm$^3$ stroke, proper functioning is assured.

Under extreme conditions, these 3 cm$^3$ can be accommodated in the reservoir 27. For this purpose, the pressure in the reservoir may rise to 3000 N/cm$^2$. Thus, a pressure difference of $3000-1200=1800$ N/cm$^2$ is available for the storage. If the published values of around 0.7%/1000 N/cm$^2$ are taken as a basis for the compressibility of the oil (which values apply for air-free oil, which in practice however are always exceeded and therefore are on the conservative side), then the necessary reservoir volume is 238 cm$^3$, i.e., a cylinder of, say, 55 mm dia. and 100 mm length.

In the case of large engines, the reservor 27 may be provided with a gas cavity (Gasblase) or a spring-loaded piston in order to keep the volume within limits. In the case of an automotive Diesel engine, such as was taken as a basis for the above-mentioned figures, it is not necessary to go to this length. In any case, a straightforward oil reservoir of convenient dimensions will suffice.

The present invention is, of course, in no way restricted to the specific disclosure of the specification and drawings, but also encompasses any modifications within the scope of the appended claims.

What we claim is:

1. A controllable hydraulic valve mechanism, especially for reciprocating engines and pumps, which includes:

a valve;

a drive cylinder;

a drive piston which projects into said drive cylinder, is operable by a cam, and is provided with control edges, said drive cylinder being adapted to have an interior space at that end of said drive piston remote from said cam;

a working cylinder;

a working piston which is guided in said working cylinder, operates said valve directly, and is provided with an oblique end face at that end thereof remote from said valve, said working cylinder being adapted to have an interior space at that end of said working piston remote from said valve;

a control conduit which interconnects said cylinders;

a first reservoir for control fluid;

a refilling conduit which interconnects said first reservoir and said drive cylinder;

a cooler arranged in said refilling conduit;

a pump operatively connected with said refilling conduit;

a return conduit interconnecting said refilling conduit and said first reservoir;

an overflow valve located in said return conduit;

a second reservoir for absorbing a substantial part of the energy produced by the lift of said cam;

means for providing a continuous communication between said drive cylinder interior space and said second reservoir, said second reservoir, at that portion thereof remote from said means, being provided with a bore having a restriction;

a discharge conduit interconnecting said second reservoir bore and said first reservoir;

two independently rotatable control sleeves arranged end-to-end in said drive cylinder in the axial direction thereof, said control sleeves surrounding said drive piston, each of said control sleeves being provided with a control ring groove which is adapted to cooperate with the pertaining control edge of said drive piston, the control ring groove pertaining to one of said control sleeves being connectable with said working cylinder interior space for infinite variable adjustment of the valve opening time of said drive cylinder interior space, the control ring groove pertaining to the other of said control sleeves being connectable to said first reservoir by means of a bore and pertaining restriction in said drive cylinder for infinitely variable adjustment of the valve closing time of said drive cylinder interior space;

actuating means respectively operatively associated with each of said control sleeves for respectively effecting rotation thereof, said actuating means being operable from outside said drive cylinder;

a further rotatable control sleeve arranged in said working cylinder and surrounding said working piston, said further control sleeve being provided with a control ring groove for varying the lift of said valve;

a discharge conduit which leads to said first reservoir and is connectable to said working cylinder interior space by means of said further sleeve, said oblique end face of said working piston, and said control ring groove of said further control sleeve, being adjusted in such a way that a small amount of control fluid flows into said first reservoir during each valve lift adjustment; and further actuating means operatively associated with said further control sleeve for effecting rotation thereof, said further actuating means being operable from outside said working cylinder.

2. A controllable hydraulic valve mechanism according to claim 1, in which said second reservoir is a hydraulic pressure reservoir and is mounted on said drive cylinder, said means for providing a continuous communication between said drive cylinder interior space and said second reservoir being provided by a bore in said drive cylinder.

3. A controllable hydraulic valve mechanism according to claim 1, in which said second reservoir is a spring-loaded piston reservoir and is mounted on said drive cylinder, said means for providing a continuous communication between said drive cylinder interior space and said second reservoir being provided by a bore in said drive cylinder.

4. A controllable hydraulic valve mechanism according to claim 1, in which said control edges of said drive piston are transverse bores in said drive piston, said drive piston being further provided with a longitudinal bore for communicating both of said transverse bores with said drive cylinder interior space.

5. A controllable hydraulic valve mechanism according to claim 1, in which those edges of said drive cylinder control ring grooves provided in the pertaining control sleeves and directed toward said drive cylinder interior space extend perpendicular to the longitudinal axis of said drive piston, and those edges directed toward said cam extend oblique to the longitudinal axis of said drive piston.

6. A controllable hydraulic valve mechanism according to claim 1, in which each of said actuating means for the pertaining control sleeve of said drive cylinder comprises a worm gear formed integrally with the pertaining control sleeve and a worm extending through said drive cylinder.

7. A controllable hydraulic valve mechanism according to claim 1, in which said further actuating means for said further control sleeve of said working cylinder comprises a worm gear formed integrally with said further control sleeve, and a worm extending through said working cylinder.

8. A controllable hydraulic valve mechanism according to claim 1, in which said control ring groove in said further control sleeve extends oblique to the longitudinal axis of said working piston and is matched with said oblique end face of said working piston in such a way that when the lowermost point of said end face coincides with the upper edge of said control ring groove of said further control sleeve, passage of control fluid is released to said first reservoir.

9. A controllable hydraulic valve mechanism according to claim 1, in which said refilling conduit, which leads from said first reservoir to said drive cylinder, includes a branch circuit which leads to said second reservoir, a shut-off type non-return check valve being provided in said branch circuit and being capable of being shut off in a direction towards said first reservoir.

10. A controllable hydraulic valve mechanism according to claim 1, in which said oblique end face of said working piston is provided with small wedge-shaped notches.

* * * * *